US006000811A

United States Patent [19]

Bordak

[11] Patent Number: 6,000,811

[45] Date of Patent: Dec. 14, 1999

[54] HANGING EMERGENCY LIGHT ASSEMBLY

[76] Inventor: John Joseph Bordak, 710 Parkview Ave., Langhorne, Pa. 19407

[21] Appl. No.: 09/037,570

[22] Filed: Mar. 10, 1998

[51] Int. Cl.[6] ..... F21L 15/08

[52] U.S. Cl. ..... 362/158; 362/184; 362/190; 362/205; 340/321; 340/331

[58] Field of Search ..... 362/158, 184, 362/190, 191, 186, 205, 228, 267; 340/321, 331, 908

[56] References Cited

U.S. PATENT DOCUMENTS

| | | | |
|---|---|---|---|
| 1,466,350 | 8/1923 | Barany | 362/184 |
| 2,492,296 | 12/1949 | Koblas | 340/331 |
| 2,739,305 | 3/1956 | Harmon | 362/184 |
| 2,816,277 | 12/1957 | Salkowski | 362/184 |
| 3,063,046 | 11/1962 | Hurst | 340/331 |
| 3,493,924 | 2/1970 | Dobbins | 340/321 |
| 5,671,999 | 9/1997 | Guthrie et al. | 362/184 |
| 5,865,524 | 2/1999 | Campman | 362/184 |

*Primary Examiner*—Alan Cariaso
*Attorney, Agent, or Firm*—Goldsten & Caninio

[57] ABSTRACT

A hanging emergency light assembly comprising a portable housing which includes a compartment for accommodating at least one battery for supplying electric power, and opposite first and second light emitting ends. The first light emitting end of the portable housing is provided with a strobe lamp and a red colored lens for emitting a red colored strobe light. The second light emitting end of the portable housing is provided with a high intensity light bulb and a clear lens for emitting blinking high intensity light. The hanging emergency light assembly further comprises first and second switches for independently activating and deactivating the strobe lamp and the high intensity light bulb, respectively. The portable housing includes a flange extending upwardly therefrom for accommodating a ring and an elastic band removably placed around the ring for allowing the light assembly to conveniently hang on a door knob or a fixture in order to alert an emergency service personnel or nighttime delivery to one's location.

5 Claims, 1 Drawing Sheet

HANGING EMERGENCY LIGHT ASSEMBLY

BACKGROUND OF THE INVENTION

This invention relates to a hanging emergency light assembly. More particularly, the invention relates to a light assembly which is designed to hang on a door knob or other fixture and emit a red colored strobe light or rapidly flashing high intensity light upon selective activation thereof for alerting and directing emergency service personnel or a nighttime delivery to the location of the user.

Many emergency situations arise at nighttime in a wide variety of locations, including near the road, at home, in deserts, in mountains, and many other places. Because many emergency situations require immediate assistance, it is critical for the emergency service to respond as quickly as possible in order to avoid harmful results. However, in the dark, it is often difficult for emergency service personnel to locate the person seeking help. Inability to locate the person seeking emergency help in a timely manner may not only result in harm and furtherance of an injury but also result in a person loosing their life while waiting for a medical assistance. Thus, it is desirable to have an inexpensive device that is capable of quickly alerting and directing emergency service personnel to the location of the individual seeking help.

Various references uncovered in the prior art provide emergency lighting devices with high intensity flash elements. For example, U.S. Pat. No. 4,613,847 to Scolari discloses a self-contained emergency signal having a base which contains a battery, a high-intensity flash lamp and a high-intensity flash lamp actuating unit. U.S. Pat. No. 4,112,482 to Powell discloses a night light belt provided with red or amber colored rear lamp and a red or white front lamp that is manually removable from the belt, for use as a portable flashlight.

In the field of lighted signs, many have been designed to illuminate street numbers of the building for facilitating the finding of a particular residential address. For instance, U.S. Pat. No. 4,686,505 to Vanderburg discloses an emergency lighting apparatus which is activated by a homeowner in the event of an emergency. The emergency lighting apparatus includes transparent house numbers which are illuminated from behind, while a strobe Light is flashed. Likewise, U.S. Pat. No. 4,003,040 to Browand discloses a flashing address-indicating door sign comprising a casing having illuminable house numbers at the front thereof, wherein the casing contains red and white light bulbs which are selectively operable by a switch located inside of the house.

Despite all these emergency lighting devices, there is still a further need to provide an improved hanging emergency light assembly. Such a hanging emergency light assembly should be capable of alerting and directing emergency service personnel or a nighttime delivery person to the location of the individual seeking help or waiting for delivery. Moreover, such a hanging emergency light assembly should be positionable in an elevated position so that it can be easily seen by an emergency service personnel from a considerable distance, and eliminates the need to have the user manually hold such a light assembly.

While these units mentioned above may be suitable for the particular purpose employed, or for general use, they would not be as suitable for the purposes of the present invention as disclosed hereafter.

SUMMARY OF THE INVENTION

It is an object of the invention to provide a hanging emergency light assembly which is simple in construction so as to minimize manufacturing cost, and yet is capable of quickly alerting and directing emergency service personnel or a nighttime delivery person to the location of the individual seeking help or waiting for a delivery.

It is another object of the invention to provide a hanging emergency light assembly which employs a removable elastic band attached to the portable housing to allow conveniently hanging of the present invention in an elevated position so that it can be seen from a considerable distance, and to eliminate the necessity of having to manually hold the light assembly or place the light assembly on the ground.

It is yet another object of the invention to provide a hanging emergency light assembly which is assembled in a compact, portable configuration for easy storage and transport purposes.

The invention is a hanging emergency light assembly comprising a portable housing which includes a compartment for accommodating at least one battery for supplying electric power, and opposite first and second light emitting ends. The first light emitting end of the portable housing is provided with a strobe lamp and a red colored lens for emitting a red colored strobe light. The second light emitting end of the portable housing is provided with a high intensity light bulb and a clear lens for emitting blinking high intensity light. The hanging emergency light assembly further comprises first and second switches for independently activating and deactivating the strobe lamp and the high intensity light bulb, respectively. The portable housing includes a flange extending upwardly therefrom for accommodating a ring and an elastic band removably placed around the ring for allowing the light assembly to conveniently hang on a door knob or a fixture in order to alert an emergency service personnel or nighttime delivery to one's location.

To the accomplishment of the above, and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
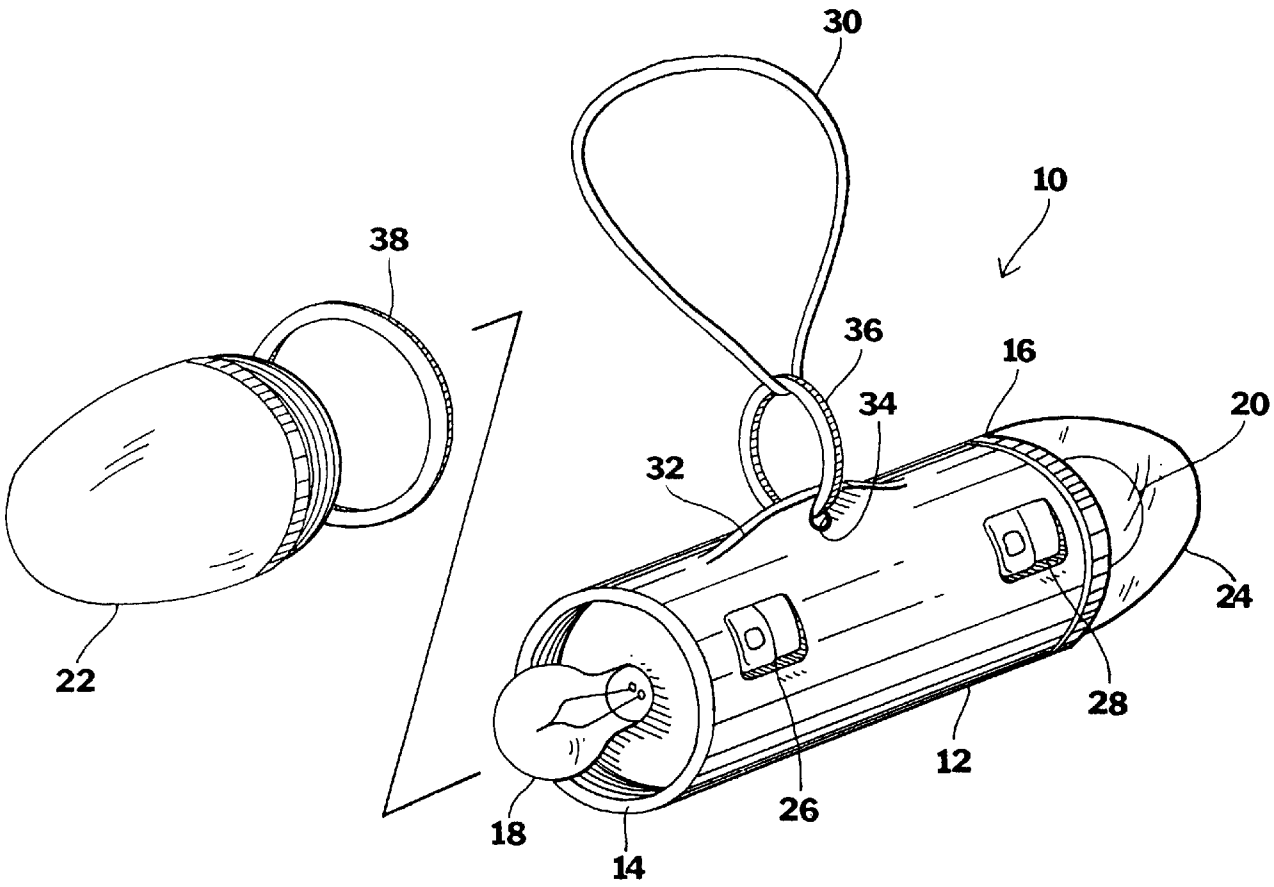
FIG. 1 is a diagrammatic perspective view of the present invention with the red colored lens and the rubber O-ring seal removed from the portable housing of the present invention.

FIG. 1 illustrates a hanging emergency light assembly 10 which includes a portable housing 12 having opposite first 14 and second 16 light-emitting ends and a compartment for accommodating at least one battery for supplying power. A strobe lamp 18 is mounted to the first light-emitting end 14 of the portable housing 12 for generating a strobe light. A high intensity light bulb 20 is mounted to the second light-emitting end 16 of the portable housing 12 for generating a flashing high intensity light.

The hanging emergency light assembly 10 further comprises first 22 and second 24 lenses, each having a dome shaped portion and an externally threaded portion for rotatably mounting to the opposite first 14 and second 16 light-emitting ends of the housing 12 for covering the strobe lamp 18 and the high intensity bulb 20. The first 22 and second 24 lenses can be removed from the portable housing 12 and interchanged with other lenses, when desired. The first 22 and second 24 lenses are constructed of a sturdy material such as high impact plastic or any other suitable material capable of protecting the strobe lamp 18 and the high intensity bulb 20. In a preferred embodiment, the first lens 22 is red colored to produce a red colored strobe light, and the second lens 24 is clear or transparent to produce white light.

The hanging emergency light assembly 10 includes first 26 and second 28 switches for independently operating the strobe lamp 18 and the high intensity bulb 20, respectively. The housing 12 includes a first circuit which electrically connects the strobe lamp 18, the battery, and the first switch 26 such that the strobe lamp 18 is energized by the battery under the control of the first switch 26. The first circuit incorporates the strobe lamp 18 with appropriate electrical connections and switching apparatus to permit flashing of the red strobe light upon the selective activation by the first switch 26. The housing 12 further includes a second circuit which electrically connects the high intensity bulb 20, the battery, and the second switch 28 such that the high intensity bulb 20 is energized by the battery under the control of the second switch 28. The second circuit incorporates the high intensity bulb 20 with appropriate electrical connections and switching apparatus to permit rapid flashing of the high intensity light 20 upon the selective activation by the second switch 28. These electrical connections and switching apparatus are well known to persons of ordinary skill in the art.

The hanging emergency light assembly 10 is provided with an elastic band 30 removably attached to the portable housing 12 so as to allow the device 10 to hang on a doorknob or other fixture. The portable housing 12 includes an integrally molded flange 32 extending upwardly therefrom, wherein the flange 32 has an aperture 34. A ring 36 is placed in the aperture 34 of the flange 32, to which the removable elastic band 30 is attached.

The hanging emergency light assembly 10 preferably has a watertight construction so that the device 10 can be reliably used outdoors under any whether condition. Accordingly, the first 26 and second 28 switches described above is selected from an appropriate watertight switch mechanism capable of achieving the desired function. A pair of rubber O-ring seal 38 is used to form a watertight seal between the portable housing 12 and the lenses 22 and 24—one O-ring seal 38 is placed between the first light-emitting end 14 of the housing 12 and the red colored lens 22, and the other O-ring seal 38 is placed between the second light-emitting end 16 of the housing 12 and the transparent lens 24.

In the event of an emergency, the hanging emergency light assembly 10 is hung on a doorknob or other fixture in an elevated position such that the light illuminating from the device 10 is not obstructed by trees or other large objects, and thus permitting visual notification to direct emergency service personnel to the location of the person seeking help. The switch 26 or 28 corresponding to the desired light effect is manually turned on to cause either the strobe lamp 18 to flash or the high intensity bulb 20 to flash rapidly. The flashing light will remain lit until a help arrives.

While the embodiments of the present invention are disclosed in relation to the hanging emergency light assembly 10 which generates a combination of a red colored strobe light and flashing high intensity light, it will be apparent to those skilled in the art that the device disclosed herein may utilize different colored lenses and light bulb types which may be selected to provide maximum visibility under different weather condition. It should be noted that the first 22 and second 24 lenses are removably secured to the portable housing 12 to permit easy interchangeability with other lenses that produce lights with different color and effect.

Many specific details contained in the above description merely illustrate some preferred embodiments and should not be construed as a limitation on the scope of the invention. Many other variations are possible.

What is claimed is:

1. A hanging emergency light assembly, said light assembly operating in combination with a portable power supply for supplying power, said light assembly comprising:

a) a portable housing, said portable housing having a compartment for accommodating said power supply, and opposite first and second light emitting ends;

b) a strobe lamp mounted to the first light emitting end of the portable housing for emitting a strobe light, said strobe lamp electrically connected to the power supply;

c) a high intensity light bulb mounted to the second light emitting end of the portable housing for emitting a high intensity light, said high intensity light bulb electrically connected to the power supply;

d) a first switch provided on the portable housing, said first switch electrically connected to the power supply, and the strobe lamp such that when said first switch is manually closed, the strobe lamp is energized by the power supply producing a flashing strobe light;

e) a second switch provided on the portable housing, said second switch electrically connected to the power supply, and the high intensity light bulb such that when said second switch is manually closed, the high intensity light bulb is energized by the power supply producing flashing high intensity light; and f) hanging means attached to the portable housing for permitting the light assembly to be hung when desired.

2. The hanging emergency light assembly as recited in claim 1, further comprising a first dome shaped lens removably secured to the first light emitting end of the portable housing for covering and protecting the strobe lamp, and a second dome shaped lens removably secured to the second light emitting end of the portable housing for covering and protecting the high intensity light bulb.

3. The hanging emergency light assembly as recited in claim 2, wherein the first lens is red colored for producing a red colored strobe light, and wherein the second lens is transparent for producing bright white light.

4. The hanging emergency light assembly as recited in claim 3, wherein the portable housing further comprises a flange extending outwardly therefrom, said flange having an aperture, and wherein the hanging means further comprises a ring placed in said aperture in the flange, and an elastic band removably placed around said ring.

5. The hanging emergency light assembly as recited in claim 4, further comprising a first O-ring seal placed between the first light-emitting end of the housing and the red colored lens for forming an watertight seal, and a second O-ring seal placed between the second light-emitting end of the housing and the transparent lens for forming an watertight seal.

* * * * *